US011536137B2

(12) United States Patent
Venter et al.

(10) Patent No.: US 11,536,137 B2
(45) Date of Patent: Dec. 27, 2022

(54) LIGHT WEIGHT ROCKBOLT COMPONENTS AND A NON-METALLIC ROCKBOLT

(71) Applicant: SETEVOX (PTY) LTD., Pretoria (ZA)

(72) Inventors: Johann Adriaan Venter, Pretoria (ZA); Eckardt Rocco Du Plessis, Pretoria (ZA); Rual Abreu, Pretoria (ZA)

(73) Assignee: SALTUS MINING AFRICA (PTY) LIMITED, Pretoria (ZA)

( * ) Notice: Subject to any disclaimer, the term of this patent is extended or adjusted under 35 U.S.C. 154(b) by 130 days.

(21) Appl. No.: 16/961,039

(22) PCT Filed: Nov. 28, 2018

(86) PCT No.: PCT/ZA2018/050060

§ 371 (c)(1),
(2) Date: Jul. 9, 2020

(87) PCT Pub. No.: WO2019/109111

PCT Pub. Date: Jun. 6, 2019

(65) Prior Publication Data

US 2021/0363885 A1 Nov. 25, 2021

(30) Foreign Application Priority Data

Nov. 28, 2017 (ZA) ..... 2017/08057

(51) Int. Cl.
*E21D 21/00* (2006.01)

(52) U.S. Cl.
CPC ..... *E21D 21/0006* (2013.01); *E21D 21/004* (2013.01)

(58) Field of Classification Search
CPC ..... E21D 21/0006; E21D 21/004; E21D 21/0026; E21D 21/0073; E21D 21/0046
See application file for complete search history.

(56) References Cited

U.S. PATENT DOCUMENTS 4,158,519 A * 6/1979 Gamlin ..... E21D 20/02 405/259.5
5,314,268 A * 5/1994 Calandra, Jr. ..... E21D 21/0006 405/259.5

(Continued)

FOREIGN PATENT DOCUMENTS

DE 29900172 U1 6/1999
GB 2323905 A 10/1998

(Continued)

OTHER PUBLICATIONS

Barnard, et al., "Inflatable Rock Bolt Bond Strength vs. Rock Mass Rating (RMR): A Comparative Analysis of Pull-Out Testing Data from Underground Mines in Nevada," 34th International Conference on Ground Control in Mining, 2015, Reno, Nevada, pp. 1-5.

(Continued)

*Primary Examiner* — Benjamin F Fiorello
(74) *Attorney, Agent, or Firm* — M&B IP Analysts, LLC

(57) ABSTRACT

The various disclosed embodiments provide a split set type composite rockbolt which has a slot extending from a chamfered tip of a tubular body portion of the rockbolt and through a neck portion partway to a collar portion. The rockbolt is made of a composite material which has a resin medium with longitudinal and circumferential fibres.

18 Claims, 8 Drawing Sheets

(56) References Cited

U.S. PATENT DOCUMENTS

| | | | | |
|---|---|---|---|---|
| 6,296,429 | B1 * | 10/2001 | Wright | F16B 31/021 405/259.1 |
| 2007/0196183 | A1 * | 8/2007 | Valgora | E21D 21/004 405/259.3 |
| 2008/0261042 | A1 * | 10/2008 | Brandstrom | E02D 5/80 428/375 |
| 2009/0297278 | A1 | 12/2009 | Tsukamoto | |
| 2011/0052332 | A1 * | 3/2011 | Oldsen | E21D 21/0033 405/259.6 |
| 2012/0163924 | A1 * | 6/2012 | Rataj | E21D 21/0033 405/259.3 |
| 2012/0301228 | A1 | 11/2012 | Taenzer et al. | |
| 2014/0072372 | A1 | 3/2014 | Vosbikian | |
| 2015/0204192 | A1 * | 7/2015 | Venter | E21D 15/502 405/288 |
| 2019/0390550 | A1 * | 12/2019 | Abreu | E21D 21/0046 |

FOREIGN PATENT DOCUMENTS

| | | | |
|---|---|---|---|
| WO | 2014071442 | A1 | 5/2014 |
| WO | 2017015677 | A1 | 1/2017 |

OTHER PUBLICATIONS

The International Search Report and the Written Opinion of the International Searching Authority for PCT/ZA2018/050060, dated Mar. 118, 2019, ISA/EP, The Netherlands, Rijswijk.

Tomory, et al., "Factors Influencing the Effectiveness of the Split Set Friction Stabilizer Bolts," CIM Bulletin, vol. 91, No. 1018, 1998, pp. 3-38.

* cited by examiner

DETAIL CC

LIGHT WEIGHT ROCKBOLT COMPONENTS AND A NON-METALLIC ROCKBOLT

The entire contents of South African Patent Application 2017/08057 of 28 Nov. 2017 from which this application claims priority, including the entire description, drawings, graphs, and photographs therein are incorporated in this specification by reference as if specifically reproduced herein.

FIELD OF THE INVENTION

The invention relates to rockbolts used in mining, construction, tunnelling, and the like. In particular the invention relates to a split set friction composite rockbolt and non-metallic components there for.

BACKGROUND TO THE INVENTION

Split type rock bolts have been known since the 1970's and a review of these rockbolts can be found in a paper entitled "investigation of Expanding Split Sets" by GR Davison and PG Fuller and published in "Ground Support 2013—Y. Potvin and B. Brady (eds)© 2013 Australian Centre for Geomechanics, Perth, ISBN 978-0-9806154-7-0" which can be found at https://papers.acg.uwa.edu.au/p/1304_09_Davison/.

These split type rockbolts, often referred to as split set rockbolts, were invariably made of steel.

In the above reference the authors describe the working of these metallic split type rock bolts and their advantages as follows in the abstract to the paper:

"Expanding rockbolts anchor to the rock mass using friction and mechanical interlocking at the rockbolt interface. An internally expanding friction rockbolt is capable of generating much higher radial force along its entire length than standard friction bolts. This results in increased friction between the rock mass and the friction bolt. Tubular form expanding friction bolts have never gained a following in Australia due to perceived installation issues, relatively low tensile strength and corrosion problems associated with the thin expansion walls. This paper shows that Jumbo installation of expanding friction rockbolts is now possible with the same ease as traditional 'Split Set' style friction bolts. The expanding friction bolt discussed in this paper has the same material properties as conventional friction bolts, but provides increased corrosion protection and increased anchorage capacity per embedded metre due to the expanding properties of its grout core."

SUMMARY OF THE INVENTION

In this specification, unless explicitly stated or the context clearly indicates to the contrary, a composite material is to be understood as being a combination of resinous matrix or binder reinforced with fibres (short or continuous fibres and fillers) in varying orientations from 0 deg. (parallel to bolt longitudinal axis) to 90 deg. (circumferential orientation perpendicular to bolt longitudinal axis) or random orientated short fibres.

According to a first aspect of the invention, there is provided a non-metallic collar for a rockbolt.

The collar may be made of a polymeric or composite material.

The collar may be made up of three or more layers, wherein a first inner layer includes circumferential fibres in a resinous medium creating a wedge, a second layer includes longitudinal fibres in a resinous medium extending over the wedge to the driving end of the collar where the rockbolt will be driven from by a driving force such as hammering, and a third layer again includes circumferential fibres in a resinous medium creating a counter wedge or ring to enable clamping of the longitudinal fibres when pulling on the collar with a force.

The collar may be tubular.

The collar may be hollow.

The collar may be solid.

The first inner layer fibres may include only circumferential fibres, the second layer fibres may include from 1% to 69% by count of circumferential fibres and the balance of the fibres being longitudinal fibres, and the third outer layer fibres may include only circumferential fibres.

In the specification, with reference to fibre orientation, unless the context clearly indicates the contrary, "longitudinal fibres" are fibres which extend at angles in the range of −30 deg, 0 deg, to +30 deg with reference to a long axis of the rockbolt, tubular body, or neck portion, as the case may be, and "circumferential fibres" or "hoop fibres" are fibres which extend at angles in the range of −70 deg, 90 deg, to +70 deg with reference to longitudinal axis of the rockbolt, tubular body, or neck portion, as the case may be. "Helical fibres" are fibres wound helically using winding angles from ±30 deg to ±70 deg, and angles in between.

Helical fibres are used where there is a transition between circumferential fibres and longitudinal fibres orientation or where there is a requirement for both longitudinal and circumferential material properties in one layer.

The fibres may be selected from the group including E-glass based fibres, basalt fibres, carbon fibres, aramid fibres, metal fibres or strands, natural fibres, and engineered thermoplastic fibres.

The resinous medium may be a resin selected from the group including epoxy, polyester, vinyl ester, polyurethane, polypropylene, polyethylene, nylon, PET, cement, and ceramic resin.

The resinous medium may be phenolic resin known for its flame resistant properties.

According to a second aspect of the invention there is provided a non-metallic tubular body for a rockbolt wherein a portion of the tubular body is split or has a slot therein.

The tubular body may be made of a polymeric or composite material.

The tubular body may have a chamfered leading edge.

The tubular body is described further herein below.

According to a third aspect of the invention there is provided a non-metallic intermediate tubular neck portion for a rockbolt, said neck portion having one end zone of greater diameter than the other end zone. The neck portion may in use be interposed between the rockbolt's tubular body and the collar.

The neck portion may be made of a polymeric or composite material.

The neck portion may be made of two or more layers of composite material, wherein one or more layers has longitudinal fibres and one or more further layers have circumferential fibres.

Helical fibres may be used where there is a transition between circumferential fibres and longitudinal fibres orientation or where there is a requirement for both longitudinal and circumferential material properties in one layer.

The fibres of the neck portion may be from 1% to 69% by count of circumferential fibres and the balance of the fibres being longitudinal fibres.

The wall thickness of the neck portion may vary along the length thereof thereby providing strength to the tubular body of the rockbolt between the collar portion and the tubular body.

The neck portion may be smaller in diameter than the tubular body portion and at least part of this portion may be smaller in diameter than the smallest rock hole size to allow the neck portion to fit within the rock hole without need to compress as a significant part of the neck portion does not have a slot or split to allow for compression.

According to a further aspect of the invention there is provided a non-metallic split type friction composite rockbolt with a tubular body which includes having a collar portion, a tubular body having a split therein, and a neck portion intermediate the collar portion and the tubular body.

The rockbolt may thus be made of a one or more of a polymeric and a composite material.

The slot or split may extend along at least a portion of the length of the body starting at one end of the body, referred to as a rockbolt tip and which, in use, will be a leading edge as the rockbolt is driven into a hole. The slot may end close to an opposite end of the body where a collar is positioned by means of an intermediate neck portion.

In use, the slot in the tubular body closes and the cross section dimension decreases as the rockbolt of which the tubular body is a part gets driven into a hole in the rock or other mineral formation so that the friction resisting withdrawal of the rockbolt from the hole results in high pull resistance. In one embodiment, the rockbolt can resist a pull out force of at least 10 tons.

The outer diameter of the tubular body of the rockbolt may be greater than the inner diameter of a hole into which it is to be driven. The rockbolt may be designed for any diameter hole.

Spaced apart resiliently deformable inserts may be inserted into the tubular body.

The resiliently deformable inserts may be made of a polymer material, such as polyethylene. The inserts may be spherical, cylindrical, or any other suitable shape. The inserts may be solid or porous.

The tubular body of the rockbolt may be made of a composite material with a combination of resinous medium with longitudinal fibres, for tensile and compressive strength (for when an axial pulling load is placed on the rockbolt or when the rockbolt is hammered into the hole), and circumferential fibres for hoop strength and stiffness of the tube (for enabling friction).

The fibres of the tubular body may have from 1% to 59% by count circumferential fibres and the balance of the fibres being longitudinal fibres The tubular body may be made of two or more layers of composite material, wherein one or more layers has longitudinal fibres and one or more further layers have circumferential fibres.

The longitudinal fibres may be continuous fibres in the 0-30 degree orientation relative to the longitudinal axis of the tubular body so as to accommodate high axial tensile and compressive loads along the length of the rockbolt.

The circumferential fibres may be continuous circumferential fibres thereby to permit high radial compressive loads which in turn provides high frictional clamping forces with the rock within the hole.

The fibre orientation along the length of the rockbolt may vary from layer to layer.

Helical fibres are used where there is a transition between circumferential fibres and longitudinal fibres orientation or where there is a requirement for both longitudinal and circumferential material properties in one layer.

The wall thickness of the tubular body may vary along the length thereof.

The composition of the composite material and wall thickness of the tubular body may vary along the length thereby to suit the loads, process, and environment.

In use, the rockbolt is driven into a hole by hammering or otherwise applying a driving force to the collar portion end of the rockbolt. The collar portion may be designed not to break off from the bolt when being pulled by a high axial load or when a hammering action is applied.

The tip of the rockbolt tubular body may be chamfered to allow the leading edge of the rockbolt to direct itself deeper into the hole even if rock strata might have moved inside the hole causing misalignment of the rock strata along the length of the hole.

A zone where the collar portion and the neck portion meet may be frangible so that the collar portion can break off during blasting so as not to leave rockbolt residue which can damage mining equipment and conveyer belts.

The rockbolt may be friable so as not to leave rockbolt residue which can damage mining equipment and conveyer belts.

The rockbolt may be manufactured using at least one of the following processes; pultrusion, filament winding, pull-winding, extrusion, press moulding, and injection moulding.

The fibres may be selected from the group including E-glass based fibres, basalt fibres, carbon fibres, aramid fibres, metal fibres or strands, natural fibres, and engineered thermoplastic fibres.

The resinous medium may be a resin selected from the group including epoxy, polyester, vinyl ester, polyurethane, polypropylene, polyethylene, nylon, PET, cement, and ceramic resin.

The resinous medium may be phenolic resin known for its flame resistant properties.

The fibres may be wound and set in resin to form the rockbolt or components thereof.

DESCRIPTION OF EMBODIMENTS OF THE INVENTION

The invention will now be described, by way of non-limiting example only, with reference to the accompanying diagrammatic drawings. In the drawings, FIG. 1 shows a typical installation of a split-set friction composite rockbolt;

Figure 1:
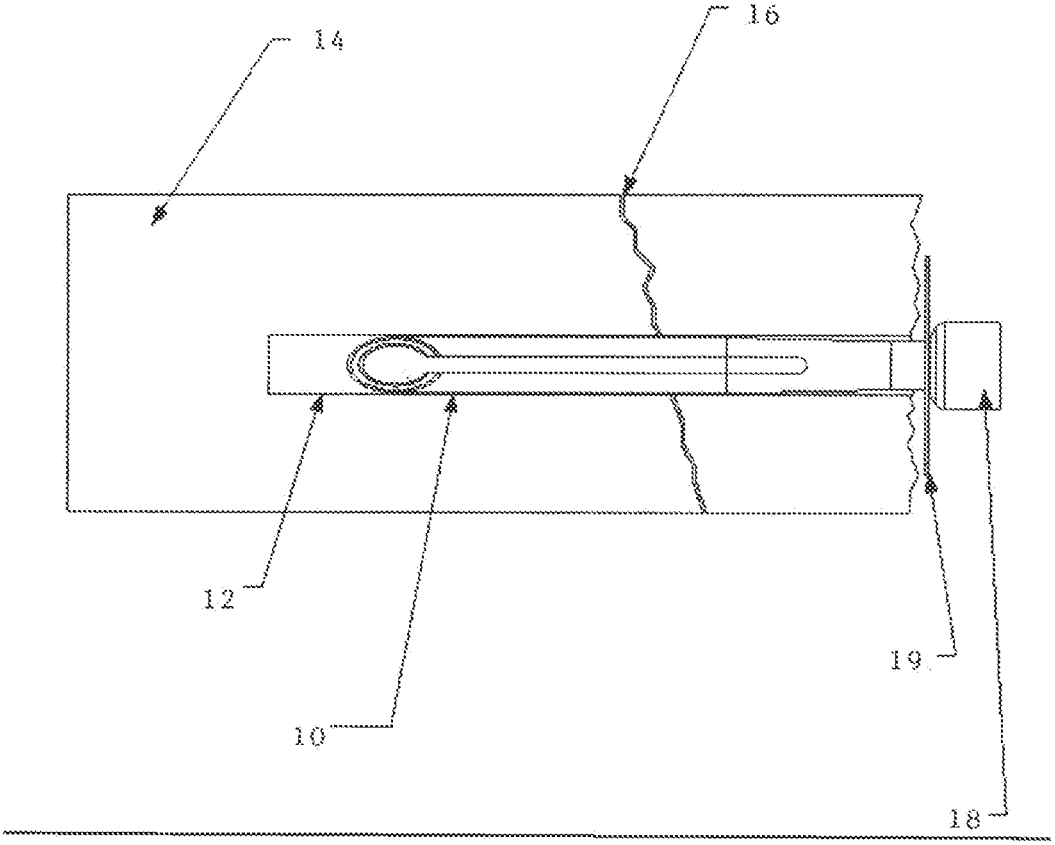

In FIG. 1, a split set type composite rockbolt 10 generally of the invention is shown driven into a hole 12 in a rock wall 14 which has a fault 16. The rockbolt 10 has a collar 18 which is used to hammer on when driving the rockbolt 10 into the hole 12 and to retain plate 19 against the rock wall 14.

Figure 2:
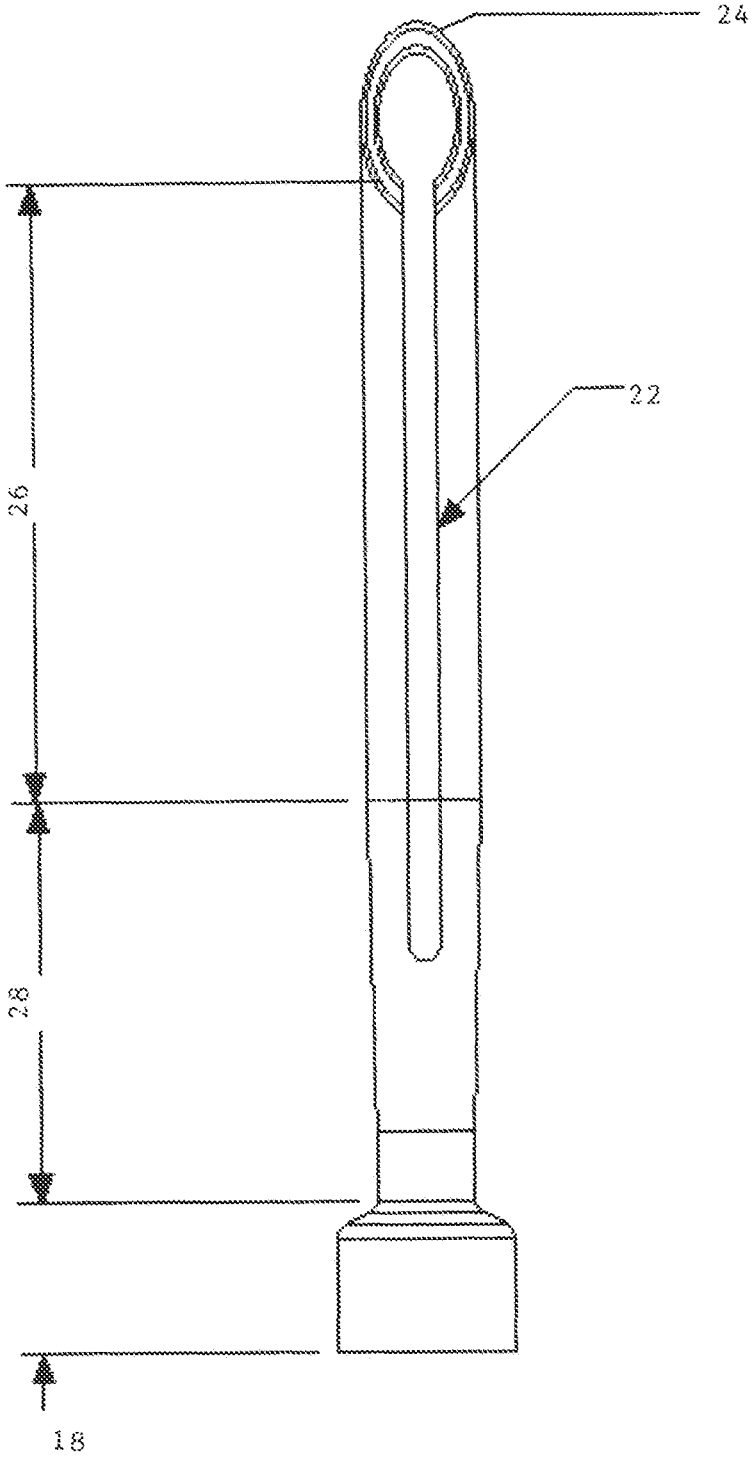
FIG. 2 shows a diagram of a tubular body of a rockbolt having a slot therethrough.

In FIG. 2, the rockbolt 10 of FIG. 1 has a slot 22 extending from the chamfered tip 24 of a tubular body portion 26 of the rockbolt 10 and through a neck portion 28 partway to the collar 18.

A split set friction type composite rockbolt 10 (for insertion into a 44 mm hole 12 as example) is shown in FIG. 2 below. The composite bolt can be designed to work for any diameter hole, however, the split set friction type composite rock bolt of the example has a 10 ton pull out resistance.

Figure 3:
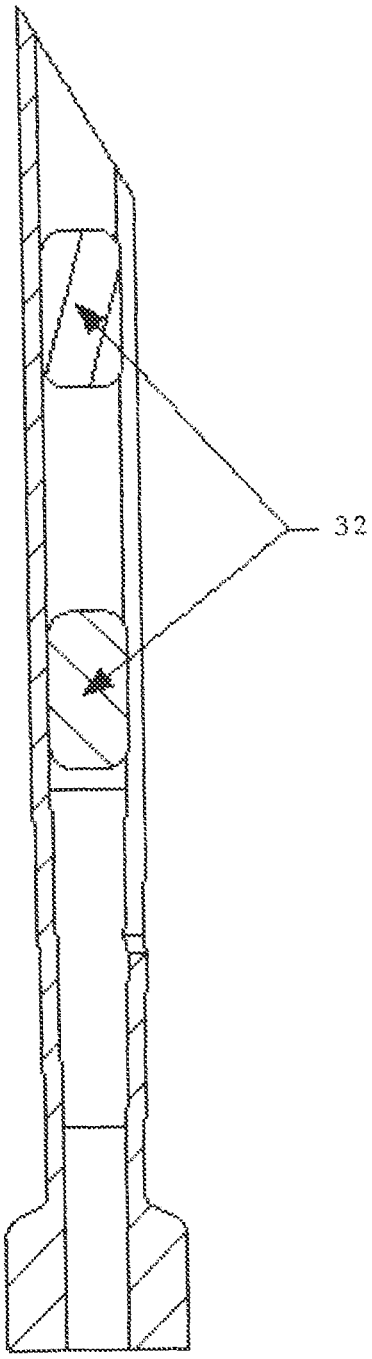
FIG. 3 shows the tubular body with spaced apart polymer inserts therein.

FIG. 3 shows an embodiment of rockbolt 10 of FIG. 2 wherein resiliently deformable cylindrical polymeric inserts 32, for example made of polyurethane, are provided spaced apart within the tubular body portion 26 to increase the forces urging the tubular body against the hole 12 where it contacts the rockbolt 10.

Figure 4:
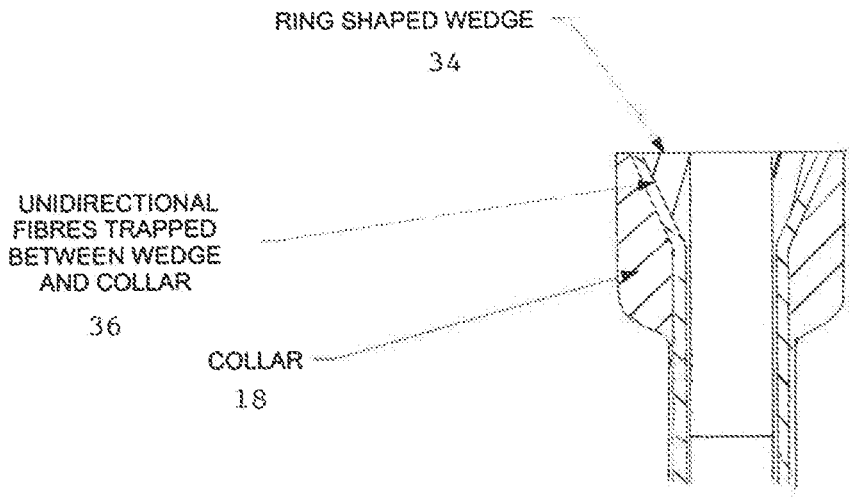
FIG. 4 shows a tubular collar portion of a rockbolt of the invention.

FIG. 4 shows a collar 18 used with rockbolt 10 of FIGS. 1 and 2, wherein unidirectional fibres 36 are trapped between a ring shaped wedge portion 34 and a collar portion 38. The collar 18 is described further hereinbelow.

Figure 5:
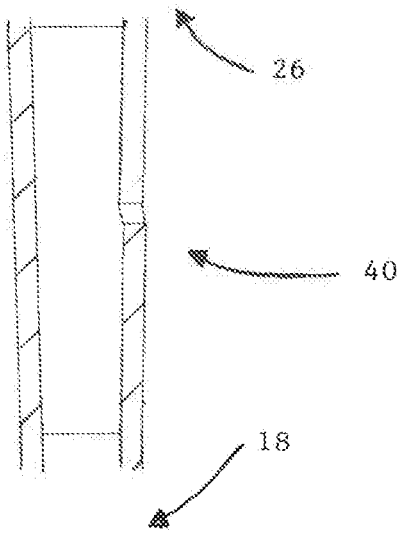
FIG. 5 shows an intermediate portion of a rockbolt which is located intermediate the tubular body and the collar.

FIG. 5 shows the intermediate neck portion 40 which is located on rockbolt 10 between the collar 18 and the tubular body portion 26. The wall thickness and diameter of the neck portion 40 changes from where it extends away from the tubular body 26 to the collar 18 as is described further below.

Figure 6:
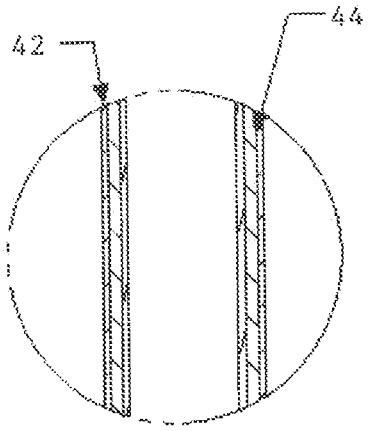
FIG. 6 shows cross section detail of the rockbolt of the invention having the tubular body, collar portion and neck portion as shown in FIGS. 2 to 5.
Figure 6:
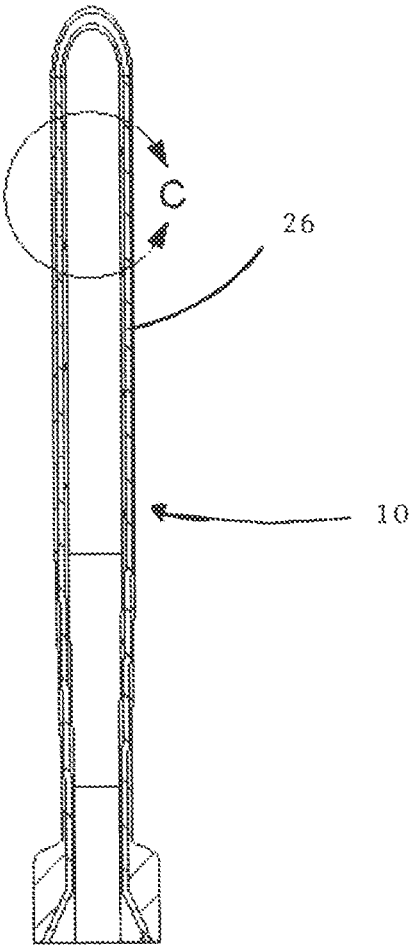
Figure 7:
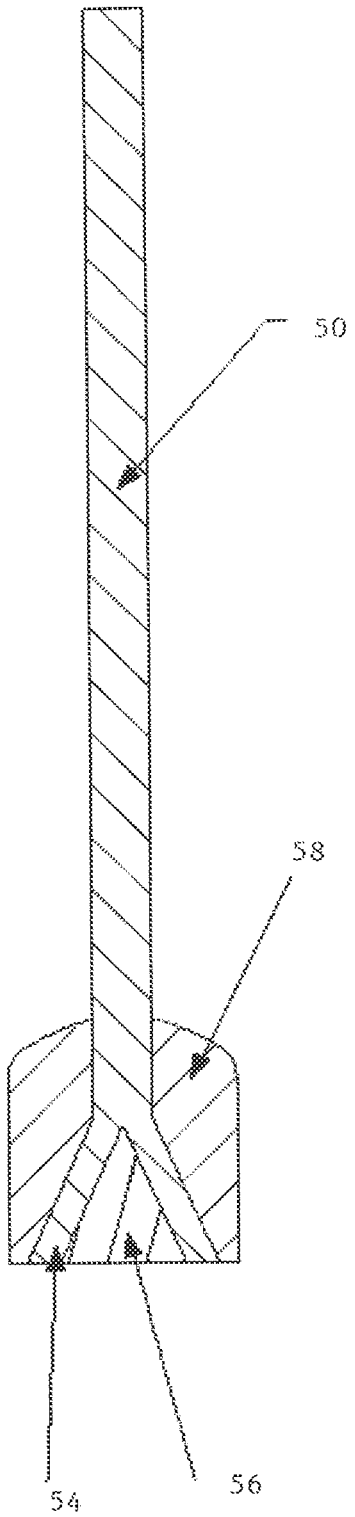
FIG. 7 shows a solid collar portion of a rockbolt of the invention.

FIG. 6 shows cross section detail of the rockbolt 10 of the invention having the tubular body portion 26 with three layers of which the inner and outer layers 42 have circumferential fibres which are continuous and a layer 44 inbetween the inner and outer layers in which the fibres are longitudinal fibres, collar 18 and neck portion 28 as shown in FIGS. 2 to 5;

FIG. 7 shows another embodiment of the rockbolt 10, here labelled as 50, which is solid, as opposed to rockbolt 10 which is hollow. The collar 52 is also solid and again unidirectional fibres 54 are trapped between a wedge portion 56 and a collar portion 58.

Figure 8:
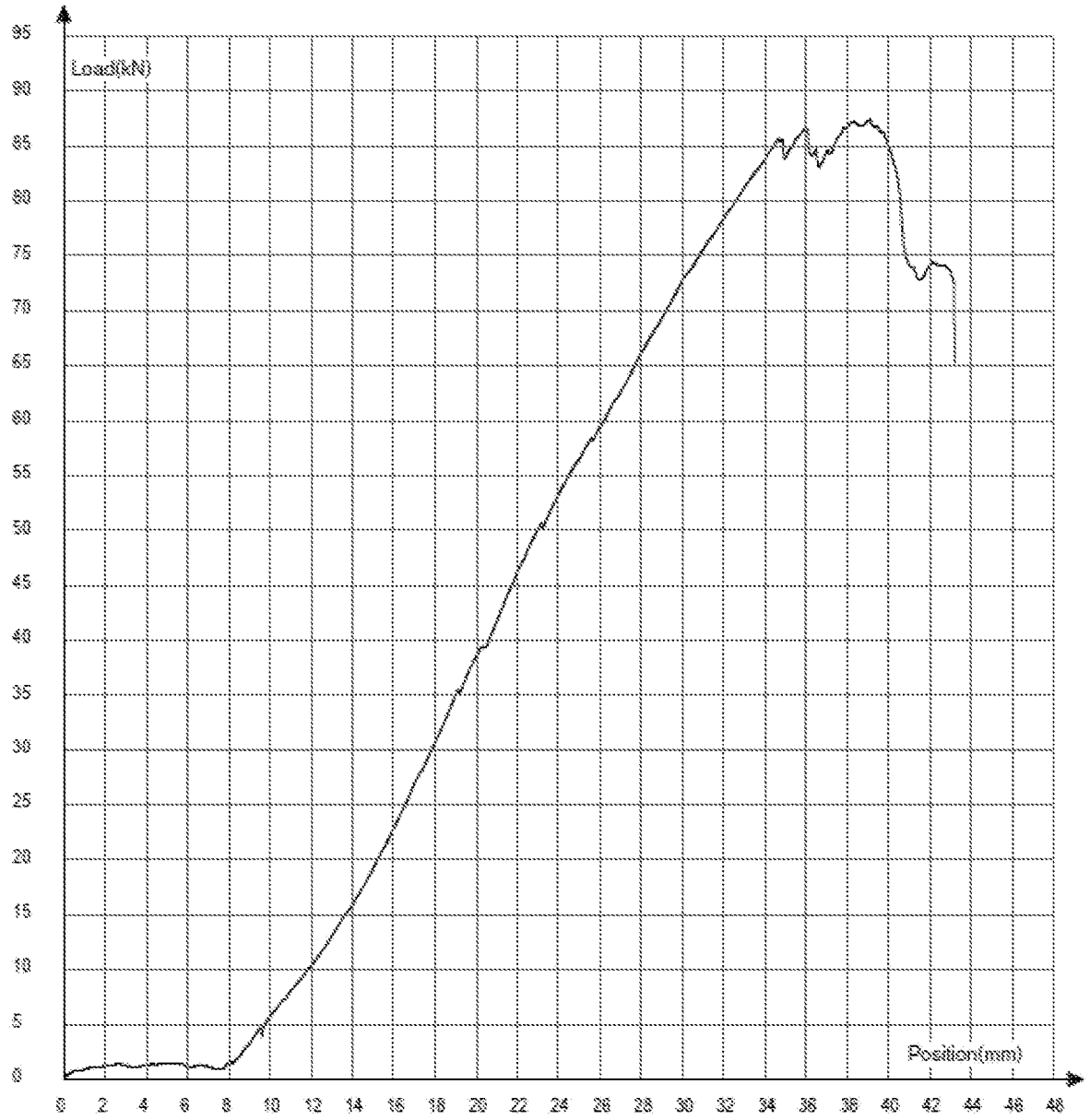
FIG. 8 shows the results from the insertion of a 46 mm outer diameter composite rockbolt into 44 mm hole in 200 mm granite block.

The result of the press force needed to insert the bolt into the granite block can be seen below in FIG. 8. It is understood that pull-out force of a split set type rockbolt is either equal to, or greater than the insertion force of an installed friction bolt, (Tomory, Grabinsky, Curran, Cavalho, "Factors influencing the effectiveness of split set friction stabilizer bolts", Canadian Instit. Mining Melallurgy Petroleum, Vol 91, Pages 205-214, 1998). Therefore, the plot in FIG. 8 should be interpreted as pull-out strength of the installed composite bolt for a 200 mm long bond, the total height of the granite cube. FIG. 8 shows the results from the insertion of a 46 mm outer diameter composite rockbolt of the invention as described herein, of which the tubular body section has the maximum percentage circumferential fibres (59% by count) and the balance of the fibres being longitudinal fibres.

Figure 9:
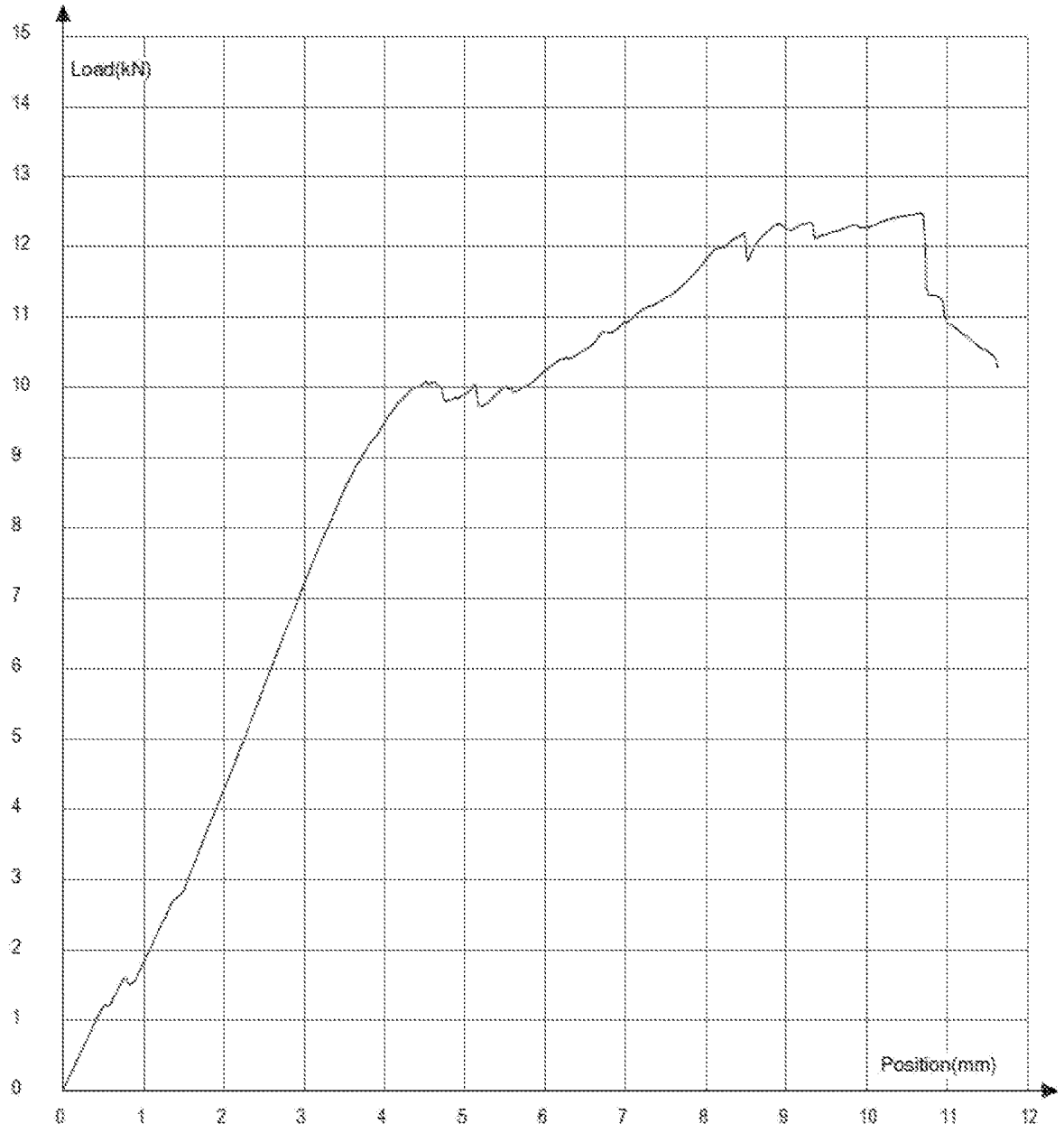
FIG. 9 shows a hoop stiffness test result for the rockbolt of the invention.

FIG. 9 shows the results of hoop stiffness test results which show a minimum of 10 kN hoop strength on the same rockbolt.

The descriptions which follow relate to the example shown in the figures.

Tensile Versus Hoop Fibre Orientation in the Rockbolt

In accordance with the invention generally, the split set type friction composite rockbolt 10 has been developed & tested that can withstand a high pull out force.

This specific rockbolt is tubular shaped and has a slot running through the length of the bolt starting at the chamfered tip (leading edge) of the rockbolt and ending close to the back end of the rockbolt where the collar is positioned. To enable the required pull out force in a typical hole diameter of 44 mm (for example), typically a 46 mm outer diameter tubular body rockbolt will be used.

The 46 mm tubular body rockbolt will then typically have a slot width of 15-16 mm wide. The tubular body compresses and the slot closes as the rockbolt gets hammered into a hole in the rock which creates friction that then results in a pull out force when the rockbolt is fully inserted into the hole.

This rockbolt has been designed with a specific optimised orientation of longitudinal and circumferential fibres to ensure that there is an optimal balance between hoop stiffness in the tube (for enabling friction) and tensile and compressive strength (for when an axial pulling load is placed on the bolt or when the bolt is hammered into the hole). The fibres can be pultruded, pull wound or filament wound. This lay-up has been found to give the optimal tensile versus hoop strength to also enable robustness for when the rockbolt is hammered into the hole. Typically the hole is then 2 mm smaller than the rockbolt outer diameter.

The longitudinal fibres are continuous fibres in the 0-30 degree orientation so as to accommodate high axial tensile and compressive loads along the length of the rockbolt. The axial fibres are continuous fibres in the circumferential orientation (70-110 deg relative to the longitudinal axis) thereby to permit high radial compressive loads which in turn provides high frictional clamping forces with the rock within the hole.

In this example. The fibres used were E-glass based and the resin is polyester resin.

The tip of the rockbolt's tubular body is chamfered to allow the rockbolt to direct itself deeper into the hole even if rock strata might have moved inside the hole causing misalignment of the rock strata along the length of the hole.

Design of the Collar

The collar design is crucial for the functioning of the split set friction composite rock bolt. A typical tubular collar generally in accordance with the invention is shown in FIG. 4 and a typical solid collar is shown in FIG. 7.

The collar design of FIG. 4 or 7 for the split set type friction composite rockbolt is required to permit clamping of the fibres in the body of the rockbolt to ensure that the collar will not break off when a pulling force is applied.

The collar in FIGS. 4 and 7 has been designed specifically not to break off from the rockbolt when being pulled by a high axial load or when a hammering action is applied.

The collar 18 of the example is made up of three layers, the first inner layer including resin and circumferential fibres creating a wedge, the second layer including resin and fibres in the body of the rockbolt running over the wedge to the back end of the rockbolt, and the third layer again including resin and circumferential fibres creating a counter wedge or ring to enable clamping of the unidirectional longitudinal fibres of the rockbolt when pulling on the collar with a force. The clamped or trapped longitudinal fibres end in the ring counter wedge or collar. The wedge would typically be from 5 degrees to 45 degrees measured from the bolt long axis.

Wall Thickness Variation where Slot Starts at Back End of Bolt

As can be seen from FIG. 6, the wall thickness reduces from the back end to the front end of the rockbolt to ensure strength of the rockbolt where the slot starts. It is believed that this variation in wall thickness ensures that the rockbolt is strong enough at the back end at the point where the slot starts for when the rockbolt is hammered into the hole. This is then an optimisation of strength of the bolt and minimising the amount of composite material in the bolt to minimise cost.

Material of Construction of Bolt

In the example, the fibres are E-glass based. The resin used in the example is phenolic resin for its flame resistant properties.

The rockbolt of the example is produced by filament winding.

Several advantages of the composite rockbolt of the invention include:

All composite solution

Contains no metallic materials

High effectivity on grip and rock retention

Very low weight

Do not corrode

Fully adaptable design for different application environments

Composite materials have better physical properties than steel because of the tailored fibre orientation within.

A wide variation of fibre and resins can be used to suit different application conditions Bolt can be cut by automated mining machines without damaging the equipment and conveyor belts No broken bolt residue left behind after blasting.

The invention claimed is:

1. A non-metallic split type friction composite rockbolt, comprising:

a non-metallic collar portion;

a non-metallic tubular body having a split or a slot therein; and a non-metallic neck portion intermediate to the collar portion and the tubular body, wherein the rockbolt is made of one or more of a polymeric and a composite material, wherein the slot or the split extends along at least a portion of a length of the tubular body starting at one end of the tubular body and comprising a rockbolt tip as a leading edge when the rockbolt is driven into a hole, and wherein the collar portion and the neck portion meets at a zone which is frangible such that the collar portion breaks off from the neck portion in a blast.

2. The non-metallic rockbolt as claimed in claim 1, wherein the slot or split ends close to an opposite end of the body where the collar is positioned by means of an intermediate neck portion.

3. The non-metallic rockbolt as claimed in claim 1, wherein the tubular body has a combination of resinous medium with longitudinal and circumferential fibres.

4. The non-metallic rockbolt as claimed in claim 3, wherein the fibres of the tubular body have from 1% to 59% by count circumferential fibres with a balance of the fibres being longitudinal fibres.

5. The non-metallic rockbolt as claimed in claim 3, wherein the tubular body is made of two or more layers of composite material, wherein one or more of the layers has longitudinal fibres and one or more further layers have circumferential fibres.

6. The non-metallic rockbolt as claimed in claim 3, wherein the longitudinal fibres are continuous fibres in an 0-30 degree orientation relative to an longitudinal axis of the tubular body so as to accommodate high axial tensile and compressive loads along a length of the rockbolt.

7. The non-metallic rockbolt as claimed in claim 6, wherein the fibre orientation along the length of the rockbolt varies from layer to layer.

8. The non-metallic rockbolt as claimed in claim 7, wherein the composition of the composite material and wall thickness of the tubular body vary along the length.

9. The non-metallic rockbolt as claimed in claim 3, wherein the circumferential fibres are continuous circumferential fibres.

10. The non-metallic rockbolt as claimed in claim 1, wherein the non-metallic collar portion is made from a polymeric or composite material.

11. The non-metallic rockbolt as claimed in claim 10, wherein said collar is made of three or more layers, wherein a first inner layer includes circumferential fibres in a resinous medium creating a wedge, a second layer includes longitudinal fibres in a resinous medium extending over the wedge to a driving end of the collar where, in use, the rockbolt will be driven from by a driving force, and a third layer which includes circumferential fibres in a resinous medium creating a counter wedge or ring to enable clamping of the longitudinal fibres when pulling on the collar with a force.

12. The non-metallic rockbolt as claimed in claim 11, wherein the first inner layer fibres include only circumferential fibres, the second layer fibres include from 1% to 69% by count of circumferential fibres and a balance of the fibres being longitudinal fibres, and the third outer layer fibres include only circumferential fibres.

13. The non-metallic rockbolt as claimed in claim 10, wherein the rockbolt is made of a combination of resinous medium with longitudinal and circumferential fibres, wherein the resin is selected from the group including epoxy, polyester, vinyl ester, polyurethane, polypropylene, polyethylene, nylon, PET, cement, ceramic resin, and phenolic resin.

14. The non-metallic rockbolt as claimed in claim 1, wherein the rockbolt is made of a combination of resinous medium with longitudinal and circumferential fibres, wherein the fibres are selected from the group including E-glass based fibres, basalt fibres, carbon fibres, aramid fibres, natural fibres, and engineered thermoplastic fibres.

15. The non-metallic rockbolt as claimed in claim 1, wherein the neck portion intermediate the collar portion and the tubular body has one end zone of greater diameter than another end zone.

16. The non-metallic rockbolt as claimed in claim 15, wherein said neck portion is made of two or more layers of composite material, wherein one or more layers has longitudinal fibres and one or more further layers have circumferential fibres.

17. The non-metallic rockbolt as claimed in claim 16, wherein the fibres of the neck portion are from 1% to 69% by count of circumferential fibres and a balance of the fibres being longitudinal fibres.

18. The non-metallic rockbolt as claimed in claim 17, wherein the wall thickness of the neck portion varies along a length thereof thereby to provide strength in the rockbolt between the collar and the tubular body.

* * * * *